US006632120B2

(12) United States Patent
Blackman et al.

(10) Patent No.: US 6,632,120 B2
(45) Date of Patent: Oct. 14, 2003

(54) BALLOON AND METHOD OF CONNECTING OBJECTS TO ONE OF TWO SHEETS FORMING THE BALLOON

(75) Inventors: John Blackman, Boca Raton, FL (US); Melchiore (Mike) Tripoli, III, Pittsburgh, PA (US)

(73) Assignee: Sing-A-Tune Balloons, LLC, Boca Raton, FL (US)

( * ) Notice: Subject to any disclaimer, the term of this patent is extended or adjusted under 35 U.S.C. 154(b) by 29 days.

(21) Appl. No.: 10/078,302

(22) Filed: Feb. 20, 2002

(65) Prior Publication Data

US 2003/0157864 A1 Aug. 21, 2003

(51) Int. Cl.[7] ..... A63H 3/06
(52) U.S. Cl. ..... 446/220; 446/226
(58) Field of Search ..... 446/220–226; 40/212, 214

(56) References Cited

U.S. PATENT DOCUMENTS

| | | | | |
|---|---|---|---|---|
| 1,649,770 A | * | 11/1927 | Miller | |
| 3,026,648 A | * | 3/1962 | Lemelson | |
| 4,837,955 A | * | 6/1989 | Grabhorn | 40/214 |
| 4,917,646 A | * | 4/1990 | Kieves | 446/224 |
| 5,041,047 A | * | 8/1991 | Casale | 446/220 |
| 5,108,339 A | * | 4/1992 | Kieves | 446/221 |
| 5,248,275 A | | 9/1993 | McGrath et al. | |
| 5,254,026 A | * | 10/1993 | Kaiser | 446/220 |
| 5,295,892 A | | 3/1994 | Felton | |
| 5,338,243 A | * | 8/1994 | Kieves | 446/220 |
| 5,378,299 A | | 1/1995 | McGrath et al. | |
| 5,482,492 A | | 1/1996 | Becker | |
| 5,595,521 A | | 1/1997 | Becker | |
| 5,795,211 A | | 8/1998 | Carignan et al. | |
| 5,934,310 A | | 8/1999 | Littlehorn | |
| 5,951,359 A | * | 9/1999 | Prakopcyk et al. | 446/220 |
| 6,015,472 A | | 1/2000 | Garcia | |
| 6,042,448 A | * | 3/2000 | Littlehorn | 446/220 |
| 6,244,923 B1 | | 6/2001 | Komaba | |

FOREIGN PATENT DOCUMENTS

| | | | | |
|---|---|---|---|---|
| JP | 405003970 | * | 1/1993 | 446/220 |

* cited by examiner

*Primary Examiner*—Kien T. Nguyen
*Assistant Examiner*—Jamila Williams
(74) *Attorney, Agent, or Firm*—Gibbons, Del Deo, Dolan, Griffinger & Vecchione

(57) ABSTRACT

The invention provides a balloon and a method for heat tacking one side of an object to an interior of the balloon without the other side of the object becoming attached to the balloon. The balloon is formed from at least a top sheet and a bottom sheet of a substantially gas-impermeable, heat-sealable material such as BON. A portion of the object is chosen to be heat sealed to the interior of the balloon. The reverse side of the portion of the object is coated with a heat resistant barrier such as synthetic resinous fluorine-containing polymer, heat-resistant nitrocellulose ink or the like. The object is then placed between the two sheets that form the balloon. A heating element is applied to the sheet on which the object will be attached and a pressure plate is applied on the other sheet thus forming a sandwich. This sandwich heat stakes one side of the object to the balloon while the heat resistant barrier prevents the other side from attaching to the balloon.

15 Claims, 6 Drawing Sheets

BALLOON AND METHOD OF CONNECTING OBJECTS TO ONE OF TWO SHEETS FORMING THE BALLOON

CROSS-REFERENCE TO RELATED APPLICATIONS

N/A

STATEMENT REGARDING FEDERALLY SPONSORED RESEARCH OR DEVELOPMENT

N/A

REFERENCE TO A SEQUENCE LISTING

N/A

BACKGROUND OF THE INVENTION

The present invention relates generally to non-latex balloons and more specifically to a method of attaching an object to one of two sheets of a non-latex balloon while the object is between the two sheets.

Balloons are a popular novelty item. They are often used to celebrate a special occasion, such as a graduation, a birthday, a welcome home, etc. They are also used in displays, as decorations, are given away as promotional items and are sold as souvenirs, for example at fairs, zoos, the circus, etc.

Recently, there have been many innovations to balloons. For example, although latex was, and is still a commonly used balloon material, film-like polymeric materials such as Biaxially Oriented Nylon (BON), metallic BON, etc. have become quite popular for use in manufacturing balloons. The term balloon will be used hereinafter to refer to any inflatable object that can be formed by heat sealing.

Non-latex balloons are generally formed from a valve assembly and two flexible sheets that are cut into patterns and sealed together. The valve assembly is typically formed from two lengths of polyethylene or polypropylene, heat bonded along the longer edges. During manufacture of the balloon, a "pick and place" machine tack-welds the valve in place against one of the flexible sheets. The outer edges (or peripheries) of the flexible sheets are then heat sealed to form the balloon. Some balloons have self sealing valves that are formed by placing a heat resistant ink on one of the two lengths of polyethylene or polypropylene to prevent the valve from becoming closed during the balloon assembly process. An example of such a valve can be found in U.S. Pat. No. 4,917,646 to Kieves, wherein the valve assembly is heat sealed to the balloon.

These film-like materials can be produced in a variety of colors including metallic colors, and can also be produced in transparent form. As such, these balloons can be created having multi-colored bodies and ornate designs. Moreover, when transparent materials are used, the inside portion of the balloon can be used to provide yet another dimension to the creativeness of such balloon designs.

It is becoming popular to attach novelty devices such as lights and/or sound producing devices onto film balloons. As disclosed in my copending patent application Ser. No. 09/849,735 entitled "Current Controller for an Embedded Electronic Module" a tab may be attached to the power supply which prevents the novelty device from operating while the balloon is in the deflated state. This tab may be attached to the inside of the balloon in such a way as to move the tab as the balloon is inflated. However, conventional methods of attaching items to the interior of a balloon are either relatively expensive or complex.

Thus, it would be advantageous to provide a method of attaching elements to the interior of a balloon.

BRIEF SUMMARY OF THE INVENTION

An aspect of the present invention provides a method of attaching an object, which has multiple sides, to a balloon formed from multiple heat sealable sheets at least two of which have a body portion, a stem portion, an interior and an exterior. The stem portion extends outwardly from the body portion, and the body portion and the stem portion of each of the sheets defines a periphery. The balloon sheets are bonded together generally around their peripheries to define a balloon body and a balloon stem. The method includes depositing a heat resistant coating on one of the sides of the object and placing the coated object between the body portion of the two sheets of the balloon. Then the object is heated until it attaches to the interior of one of the sheets of the balloon.

Another aspect of the invention provides a non-latex balloon that includes multiple heat sealable balloon sheets at least two of which have a body portion, a stem portion, an interior and an exterior. The stem portion extends outwardly from the body portion, and the body portion and the stem portion of each of the sheets defines a periphery. The balloon sheets are bonded together generally around their peripheries to define a balloon body and a balloon stem. The balloon includes a multi-sided object that is connected to the interior of the body portion of one of the balloon sheets. A heat resistant barrier is connected to one of the sides of the heat resistant portion of the object.

Yet another aspect of the invention provides a method of attaching an object, which has multiple sides, to a balloon formed from two heat sealable sheets each having a body portion, a stem portion, an interior and an exterior. The stem portion extends outwardly from the body portion, and the body portion and the stem portion of each of the sheets defines a periphery. The balloon sheets are bonded together generally around their peripheries to define a balloon body and a balloon stem. The method includes depositing a heat resistant coating on the interior of one of the balloon sheets and placing the object between the coated portion of the one of the balloon sheets and the other of the balloon sheets. The method also includes heating the object until it attaches to the interior of the other of the balloon sheets.

Still another aspect of the invention provides a non-latex balloon that includes multiple heat sealable balloon sheets, at least two of which have a body portion, a stem portion, an interior and an exterior. The stem portion extends outwardly from the body portion, and the body portion and the stem portion of each of the sheets defines a periphery. The balloon sheets are bonded together generally around their peripheries to define a balloon body and a balloon stem. The balloon includes a multi-sided object connected to the interior of the body portion of one of the balloon sheets. A heat resistant barrier is coupled to the interior of the body portion of another of the balloon sheets.

The invention will next be described in connection with certain illustrated embodiments; however, it should be clear to those skilled in the art that various modifications, additions and subtractions can be made without departing from the spirit or scope of the claims.

BRIEF DESCRIPTION OF THE SEVERAL VIEWS OF THE DRAWINGS

For a fuller understanding of the nature of the invention, reference should be made to the following detailed description and accompanying drawings, in which.

DETAILED DESCRIPTION OF THE INVENTION

Figure 1:
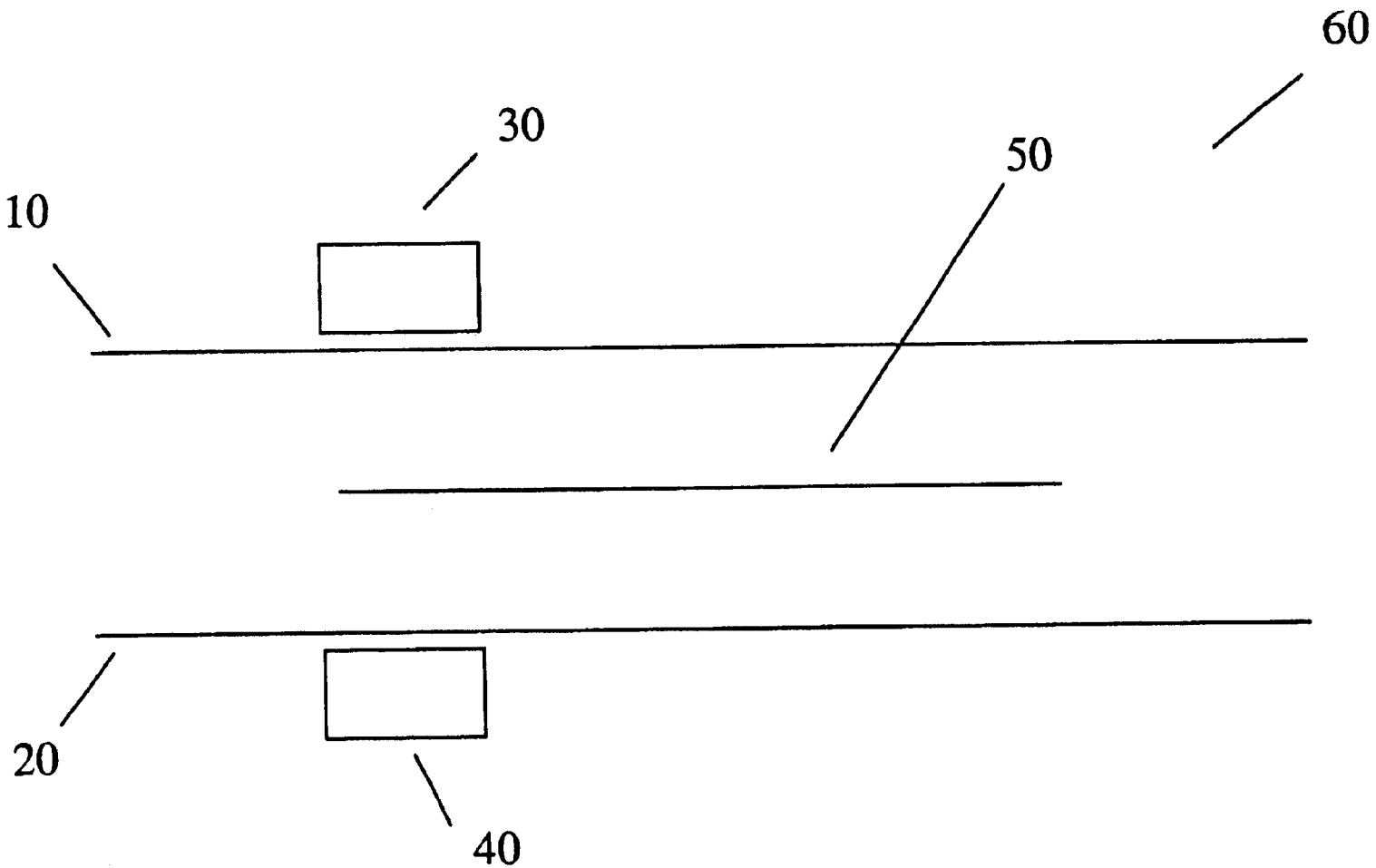
FIG. 1 is a side view of an object between two balloon sheets in preparation for attaching the object to one of the two balloon sheets in accordance with an embodiment of the invention.
Figure 2:
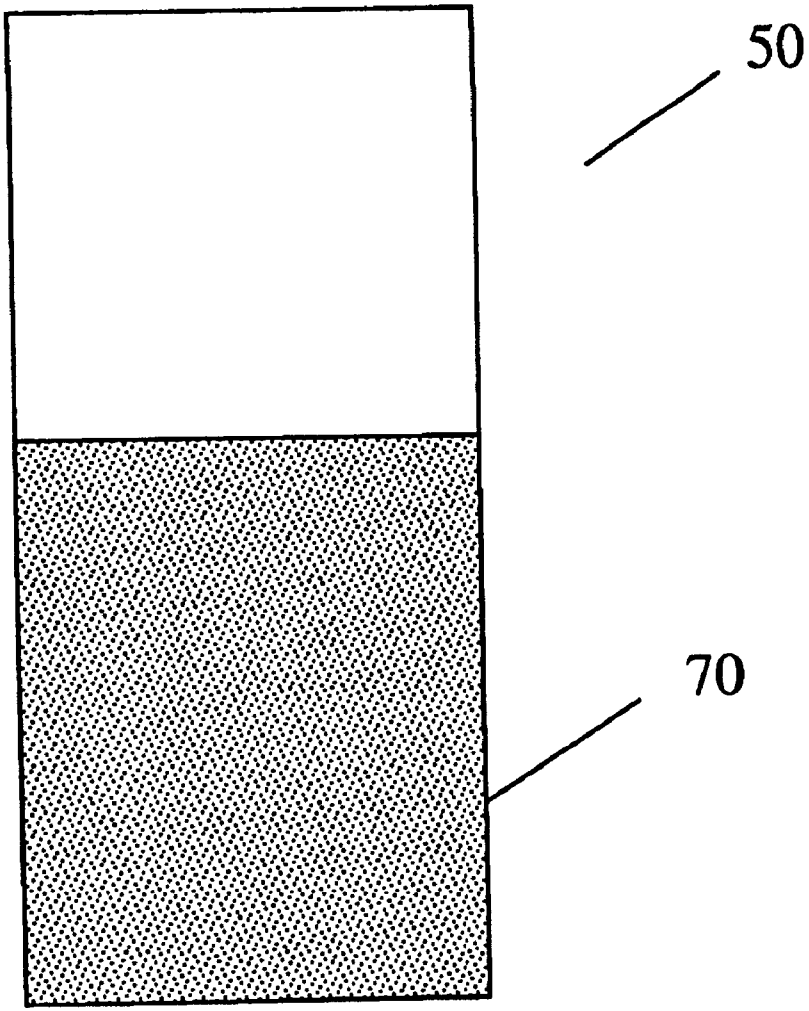
FIG. 2 is a front view of the object of FIG. 1 illustrating ink placed on a portion of the object.
Figure 3:
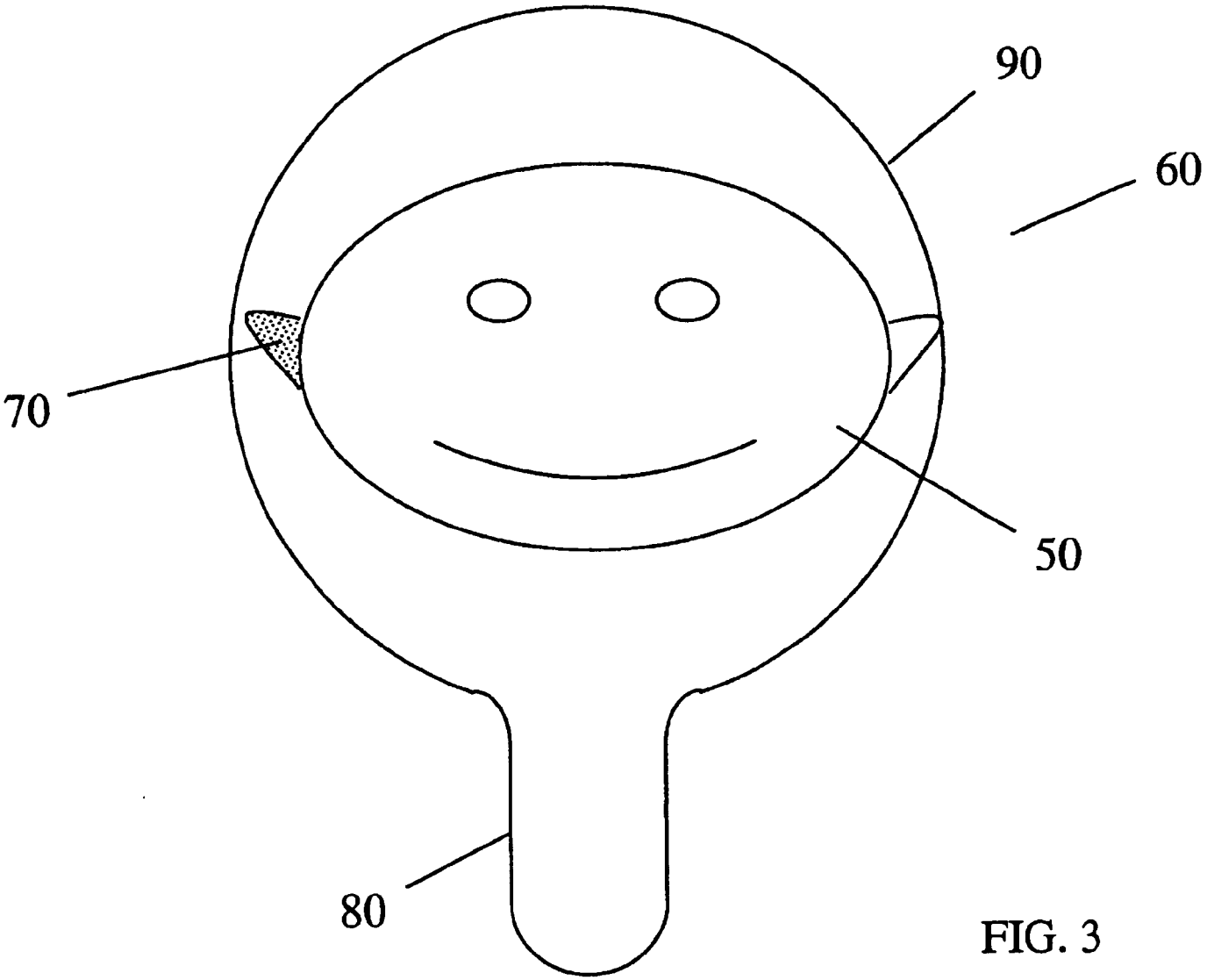
FIG. 3 is a front view of an alternate embodiment of the present invention.

As illustrated in FIGS. 1–3, the invention provides a balloon and a method for heat tacking one side of an object 50 to an interior of the balloon 60 without the other side of the object 50 becoming attached to the balloon 60. The balloon 60 is formed from a top sheet 10 and a bottom sheet 20 of a substantially gas-impermeable, heat-sealable material. In a preferred embodiment, the balloon 60 is formed from a film-like polymeric material, such as Biaxially Oriented Nylon (BON), metallic BON, or a combination thereof. Although other substantially gas-impermeable, heat-sealable materials may be used. The top 10 and bottom 20 sheets each have a body portion 90, a stem portion 80, an interior and an exterior. The stem portion 80 extends outwardly from the body portion 90, and the body portion 90 and the stem portion 80 of each of the sheets 10/20 define a periphery. The balloon sheets are bonded together generally around their peripheries to define a balloon body and a balloon stem.

The object 50 is preferably also made entirely from a heat-sealable material, although only the portion to be attached to the balloon 60 must be this material. The object 50 may be a pull tab as described in my co-pending U.S. patent application Ser. No. 09/849,735 filed May 4, 2001 entitled Current Controller for an Embedded Electronic Module which is incorporated herein by reference as if fully set forth. The object 50 may also be a 3-dimensional (3-D) object 50 that is attached to one or more different portions of the interior of the balloon 60. An example of a 3-D object 50 could be a face attached to two sides of the interior of the balloon 60 such that when the balloon 60 is inflated, the face unfolds. The 3-D object could also be an animal, a monster or any other object 50. The only requirement for the object 50 is that at least a portion of the object 50 be made from heat-sealable material.

To attach the object 50 to the interior of the balloon 60 a portion of the object 50 is chosen to be heat sealed to the interior of the balloon 60. The reverse side of the portion of the object 50 is coated with a heat resistant barrier 70 such as TEFLON synthetic resinous fluorine-containing polymer, heat-resistant nitrocellulose ink or the like. The object is then placed between the two sheets that form the balloon 60. A heating element 40 is applied to the sheet 10/20 on which the object 50 will be attached and a pressure plate is applied on the other sheet 20/10 thus forming a sandwich. This sandwich heat stakes one side of the object 50 to the balloon 60 while the heat resistant barrier 70 prevents the other side from coupling to the balloon 60. Those skilled in the art will recognize that the heat resistant barrier 70 may be placed on the interior of the balloon instead of directly onto the object 50 and still fall within the scope of the invention.

Figure 4:
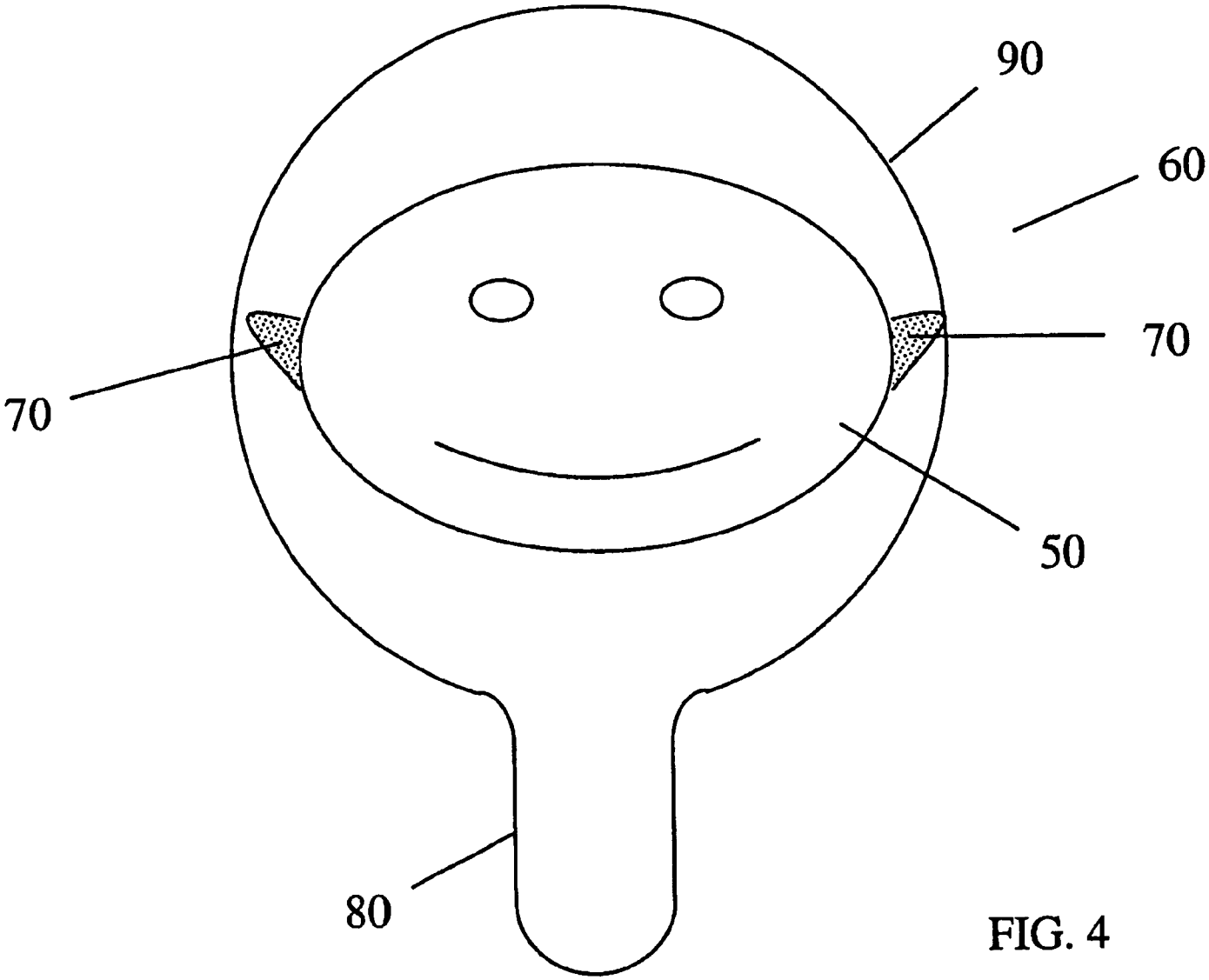
FIG. 4 is a front view of a further embodiment of the present invention.
Figure 5:
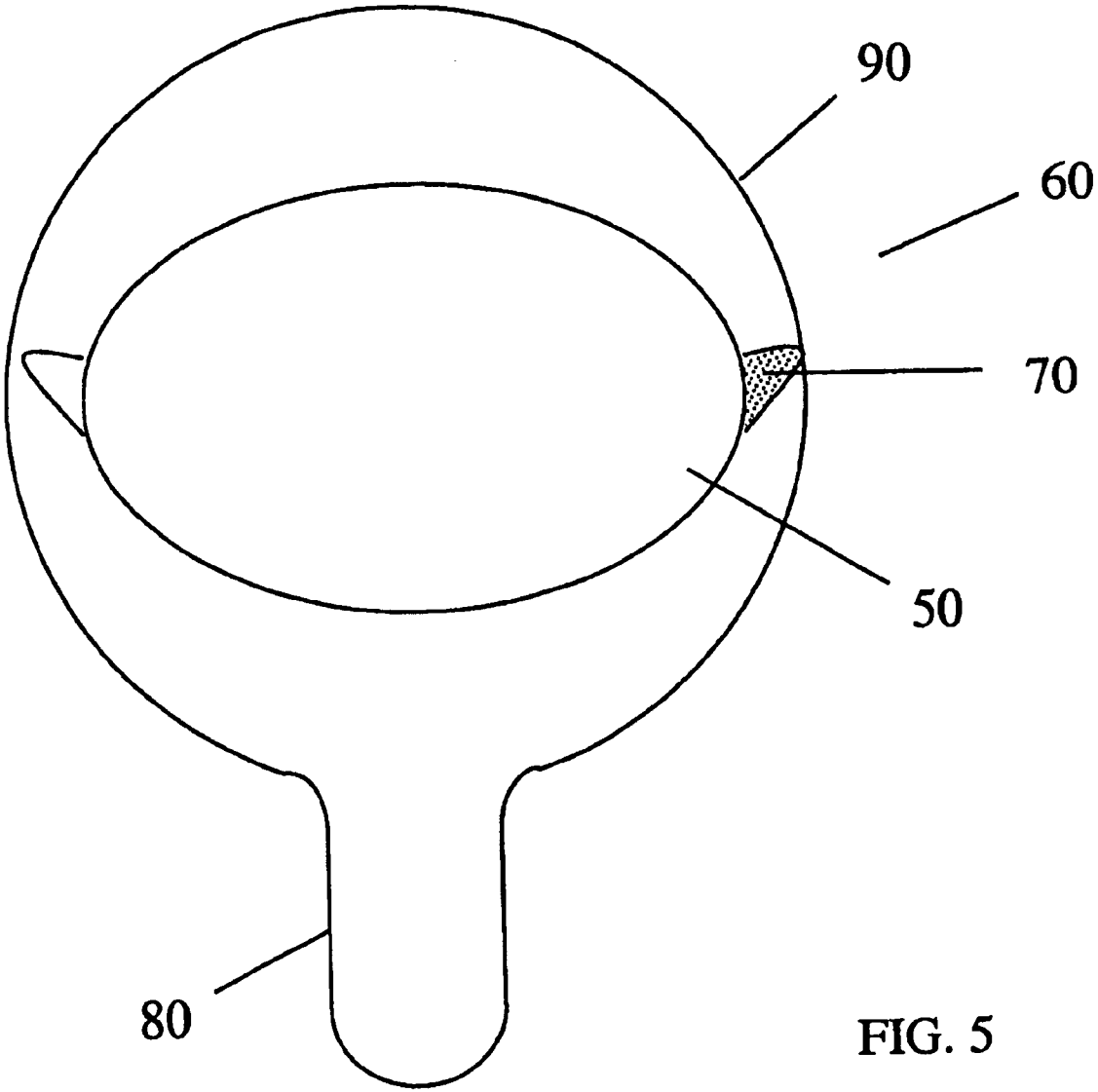
FIG. 5 is a rear view of an alternate embodiment of FIG. 3.
Figure 6:
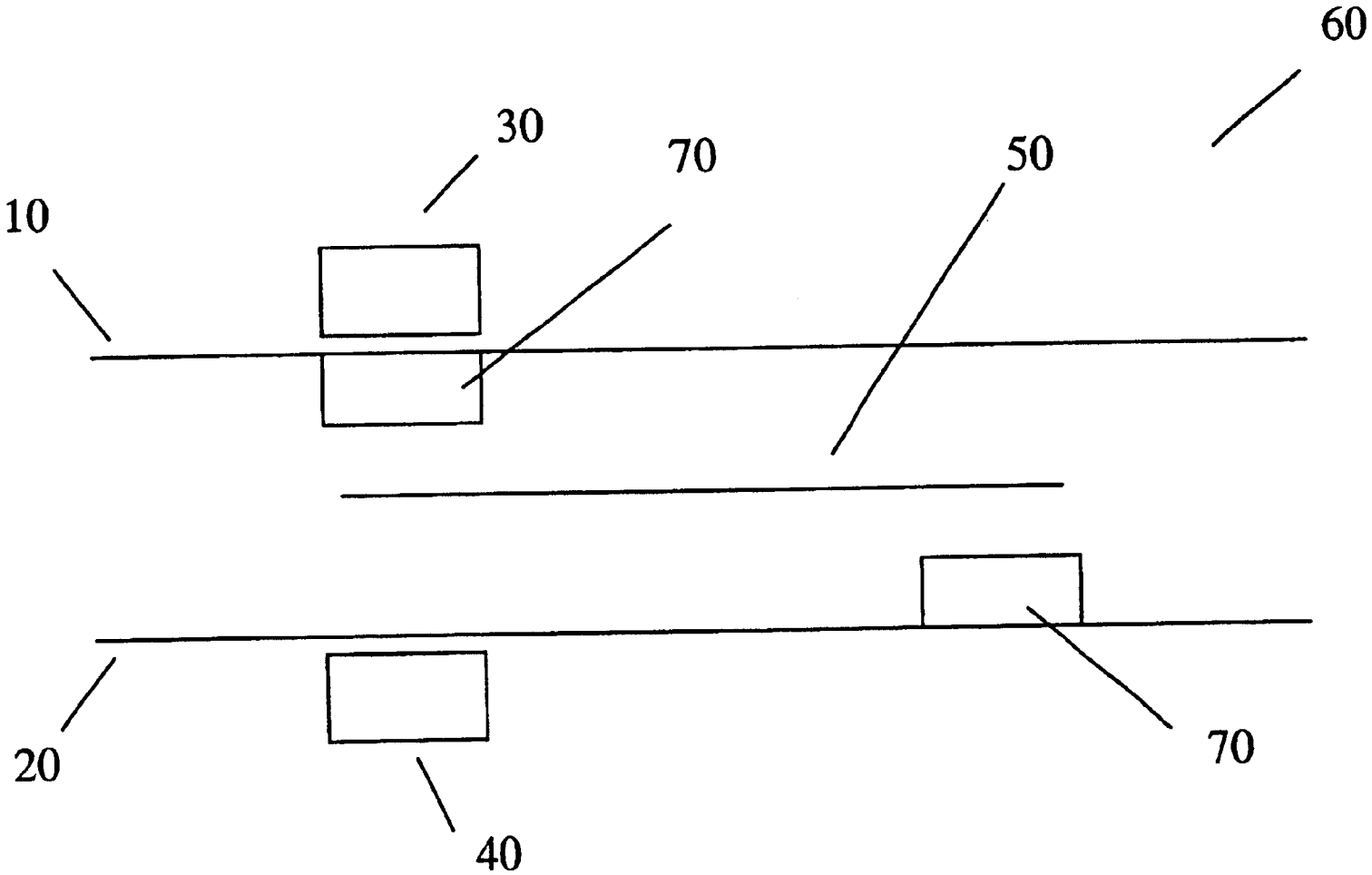
FIG. 6 is a side view as in FIG. 1 but showing heat resistant barriers.

In the configurations disclosed in FIGS. 3–5, wherein the object 50 is a three dimensional object 50 that is to be attached to the balloon 60, such as in multiple locations (e.g., the ears, etc.) of FIGS. 4 and 5, each of the different portions of the object 50 that are to be attached could be prepared with the heat-resistant barrier 70 as discussed above or each of the balloon sheet interiors could be prepared with the heat-resistant barrier 70. The portions of the object 50 however, should be askew from the remainder of the object 50 to prevent the object 50 from attaching to itself during the heating process. For FIG. 4, the heat resistant barriers 70 are on respective sections (i.e., ears) on the same side of the object 50. For FIG. 5 (whose front side is shown by FIG. 3), the heat resistant barriers 70 are on respective sections (i.e., ears) on different sides of the object 50. For FIG. 6, the heat resistant barriers 70 are shown attached to respective ones of the top and bottom sheets 10, 20 of the balloon.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

1. A method of attaching an object, which has a plurality of sides, to a balloon formed from a plurality of sheets that are heat-sealable, two of said plurality of sheets having a body portion, a stem portion, an interior and an exterior, the stem portion extending outwardly from the body portion, the body portion and the stem portion of each of said two sheets defining a periphery, the two sheets being bonded together generally around their peripheries to define a balloon body and a balloon stem, the method comprising:

depositing a heat resistant coating on one of the plurality of sides of the object;

placing the coated object entirely between the body portion of the two sheets of the balloon; and heating said object until the coated object attaches to the interior of one of the plurality of sheets.

2. The method of attaching according to claim 1 wherein the heat resistant coating is deposited on an entire one of the plurality of sides.

3. The method of attaching according to claim 1 wherein the heat resistant coating is deposited on a section of the one of the plurality of sides.

4. The method of attaching according to claim 3 wherein the heat resistant coating is deposited on a plurality of sections of the one of the plurality of sides.

5. The method of attaching according to claim 1 further comprising depositing the heat resistant coating on another of the plurality of sides of the object.

6. A non-latex balloon comprising:

a plurality of balloon sheets that are heat-sealable, two of said plurality of balloon sheets having a body portion, a stem portion, an interior and an exterior, the stem portion extending outwardly from the body portion, the body portion and the stem portion of each of said two sheets defining a periphery, the two sheets being bonded together generally around their peripheries to define a balloon body and a balloon stem;

an object comprising at least a heat sealable portion coupled to an interior body portion of one of said two balloon sheets, the object having a plurality of sides; and a heat resistant barrier coupled to one of the sides of the heat sealable portion of the object, the object being entirely between the body portions of the two sheets of the balloon.

7. The balloon according to claim 6 wherein the heat resistant barrier includes heat resistant ink.

8. The balloon according to claim 6 wherein the heat resistant barrier includes a synthetic resinous fluorine-containing polymer.

9. The balloon according to claim 6 wherein an entirety of the object comprises a heat sealable material having a plurality of sides; and the heat resistant barrier is coupled to an entire side of the object.

10. The balloon according to claim 6 wherein the object comprises another heat sealable portion coupled to the interior of the body portion of the other of the balloon sheets, the another heat sealable portion having a plurality of sides; and, another heat resistant barrier coupled to one of the sides of the another heat sealable portions of the object.

11. A method of attaching an object, which has a plurality of sides, to a balloon formed from a plurality of balloon sheets that are heat-sealable, each of at least two of said plurality of balloon sheets having a body portion, a stem portion, an interior and an exterior, the stem portion of each of said plurality of balloon sheets defining a periphery, the balloon sheets being bonded together generally around their peripheries to define a balloon body and a balloon stem, the method comprising:

depositing a heat resistant coating on the interior of one of the balloon sheets;

placing the object between the heat resistant coating and a further of the balloon sheets; and heating said object until the object attaches to the further of the balloon sheets.

12. The method according to claim 11 further comprising:

depositing the heat resistant coating on the further balloon sheet;

placing another portion of the object between the heat resistant coating of the further of the balloon sheets and the one of the balloon sheets; and heating said another portion of the object until the object attaches to the interior of the one of the balloon sheets.

13. A non-latex balloon comprising:

a plurality of heat sealable balloon sheets, at least two of said plurality of balloon sheets each having a body portion, a stem portion, an interior and an exterior, the stem portion extending outwardly from the body portion, the body portion and the stem portion of each of said plurality of sheets defining a periphery, the balloon sheets being bonded together generally around their peripheries to define a balloon body and a balloon stem;

an object comprising at least a heat sealable portion coupled to the interior of the body portion of one of said balloon sheets, the object having a plurality of sides; and, a heat resistant barrier coupled to another of said balloon sheets.

14. The balloon according to claim 13 wherein the heat resistant barrier includes heat resistant ink.

15. The balloon according to claim 13 wherein the heat resistant barrier includes a synthetic resinous fluorine-containing polymer.

* * * * *